United States Patent [19]

Hammond

[11] 4,417,364

[45] Nov. 29, 1983

[54] MOP HOLDER

[75] Inventor: Dennis A. Hammond, Ottawa, Canada

[73] Assignee: Dustbane Products Limited, Ottawa, Canada

[21] Appl. No.: 391,516

[22] Filed: Jun. 24, 1982

[30] Foreign Application Priority Data

Jan. 4, 1982 [CA] Canada ..... 393556

[51] Int. Cl.[3] ..... A47L 13/24

[52] U.S. Cl. ..... 15/147 R; 15/229 A

[58] Field of Search ..... 15/147 R, 147 A, 228, 15/229 R, 229 A, 229 B, 226

[56] References Cited

U.S. PATENT DOCUMENTS 4,135,272 1/1979 Stevenson ..... 15/147 R 4,377,879 3/1983 Christo ..... 15/229 A

FOREIGN PATENT DOCUMENTS 2361085 4/1978 France ..... 15/229 R

*Primary Examiner*—Edward L. Roberts

*Attorney, Agent, or Firm*—Burke-Robertson, Chadwick & Ritchie

[57] ABSTRACT

A holder for receiving the handle and securing the yarn of a yacht mop or the like is provided. The holder comprises a sleeve to receive in one end the handle of the mop. A base is also provided having a concave interior surface against which the yarn of the mop is to be held. The base is centrally secured to the other end of the sleeve. A pair of spaced slots provided in the base extends through the base and is located in the portion thereof circumscribed by the sleeve. The holder further comprises a flexible bundling strap having an elongated body portion. One end of the body portion is a tail end and the other end is a clinching eyelet. The clinching eyelet allows the tail end of the strap to pass through it and securely hold the strap against unpurposeful disengagement. The strap is fitted in the slots so that its tail end and clinching eyelet are positioned on the concave side of the base. The yarn of the yacht mop is circumscribed by the strap and securely held thereby within the concave interior of the base. The holder according to the present invention securely holds the yarn of the mop in place within the concave interior therein, during use. When it has a cylindrical, threaded sleeve to receive the threaded end of a handle, it may be thrown away and replaced with another unit as required, saving the handle for reuse.

8 Claims, 5 Drawing Figures

MOP HOLDER

BACKGROUND OF THE INVENTION

The present invention relates to a holder for receiving the handle and for securing the yarn of a yacht mop, toilet brush or the like.

Traditionally, a wooden handled yacht mop, consisting of long lengths of yarn or string, has been made by wrapping wire about the upper ends of the lengths of yarn positioned about the end of the handle, so that the yarns are secured in this manner to the handle. As the mop was used and became worn, the entire mop was thrown away and replaced with a new one. With the increasing cost of wood, in more recent times, it has been desirable to develop holders for the strings of a yacht mop, which holders can be detached from the handles and replaced with a new string and holder when worn. In this way the handle can be salvaged for continued use.

One such device is described and illustrated in U.S. Pat. No. 4,135,272 of Stephenson issued Jan. 23, 1979. There, a holder for the strings of a yacht mop is described and illustrated which holder consists of a dome-shaped base, having a flexible strap extending through a slot to one side thereof, about the mid-point of a bundle of strings, and out a slot on the other side thereof where the strap is secured. When the strap is tightened, it clamps the strings against the interior surface of the base. It has been found, however, with such a holder, that even by pulling the strap tightly, strings of the mop which are located about the center of the dome-shaped base tend not to be held sufficiently tightly and become displaced or completely removed from the mop.

It is an object of the present invention to provide a holder for yarns or strings for a yacht mop or the like which can releasably receive the handle for the mop and, at the same time, more securely hold the strings of the mop in place during use. It is a further object of the present invention to provide such a holder which is relatively simple and economical to construct.

SUMMARY OF THE INVENTION

According to the present invention such a holder is provided comprising a sleeve to receive in one end the handle of a mop or brush. A base, having a concave interior surface against which the yarn of the mop or brush is to be held, is centrally secured to the other end of the sleeve. A pair of spaced slots extend through the base, the slots being both located in the portion of the base circumscribed by the sleeve. The holder further comprises a flexible bundling strap having an elongated body portion. At one end of the body portion is a tail end and at the other end is a clinching eyelet. The clinching eyelet allows the tail end of the strap to pass through it and permits tightening of the straps as required and securely holds the strap against unpurposeful disengagement. The strap is fitted in the slots so that its tail end and clinching eyelet are positioned on the concave interior side of the base. Lengths of yarn of the yacht mop are circumscribed about their mid-points by the strap and the strap is tightened as required to securely hold the yarn within the concave interior of the base.

The mop holder according to the present invention provides a relatively simple, economical, replacable construction which has the ability to grip the yarn of the mop very tightly to minimize the chances of lengths of yarn held thereby becoming dislodged or loose. Since the strap, tightens upon itself, and not on the base of the holder, a more uniform and tighter grip on the yarns of the mop may be attained and a special construction of the slots of the base is not required.

BRIEF DESCRIPTION OF THE DRAWINGS

Other objects and advantages of the invention will become apparent upon reading the following detailed description and upon referring to the drawings in which.

Figure 1:
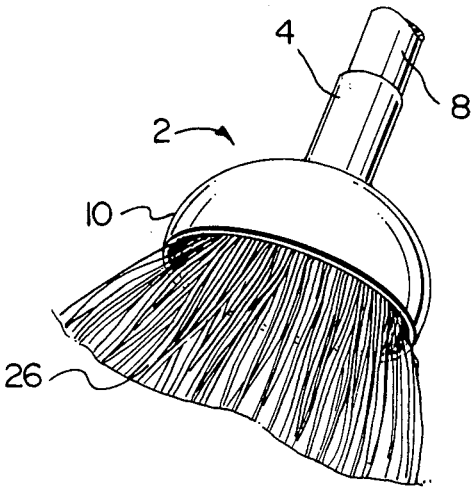
FIG. 1 is a perspective view of a holder for the yarn of a yacht mop according to the present invention.

While the invention will be described in connection with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features have been given similar reference numerals.

Figure 2:
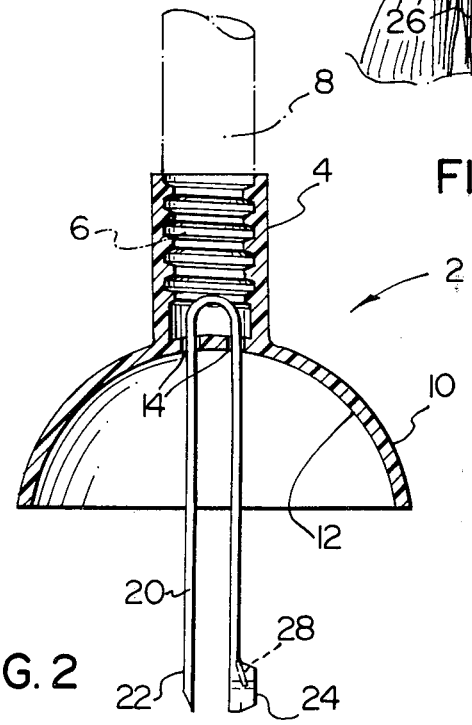
FIG. 2 is a section view, from the side, of the holder of FIG. 1 in which no yarn has yet been secured.

Turning to the drawings, in FIG. 1 there is illustrated a holder 2 for yarn for a yacht mop according to the present invention. As can be seen in FIG. 2, the holder comprises a cylindrical sleeve 4, the inner wall of which is threaded to receive the threaded end 6 of a handle 8 for the yacht mop. To the bottom end of sleeve 4 is integrally, centrally secured a dome-shaped base 10. As can be seen in FIGS. 1 and 2 base 10 has a concave interior surface 12. At the top of the dome-shaped base 10 a pair of spaced slots 14 are provided extending through base 10. As can be seen in FIG. 2, these slots are located in the portion of the base which is circumscribed by sleeve 4.

A flexible bundling strap 20 is fitted into the slots, strap 20 having at one end a tapered tail 22 and, at the other end, a clinching eyelet 24. The strap is fitted in slots 14, as shown in FIG. 2, so that tail 22 and eyelet 24 are positioned on the concave interior side 12 of the base. Tail 22 passes through clinching eyelet 24 and, as that tail 22 is drawn through the eyelet to tighten the strap about yarn 26 to be secured thereby, angled steel tongue 28 bears against the portion of the strap 20 which is within eyelet 24 to bite into the body of the strap and lock it against reverse movement in response to the strap being placed under tension. Such a strap is described in more detail in U.S. Pat. No. 3,186,047 of Schwester et al issued June 1, 1965, and has been found to be well suited to application in the present invention. Of course other self clinching straps would be no doubt suitable for the purposes of the present invention, and it is not intended to limit the scope of applicant's invention to this particular type.

Figure 3:
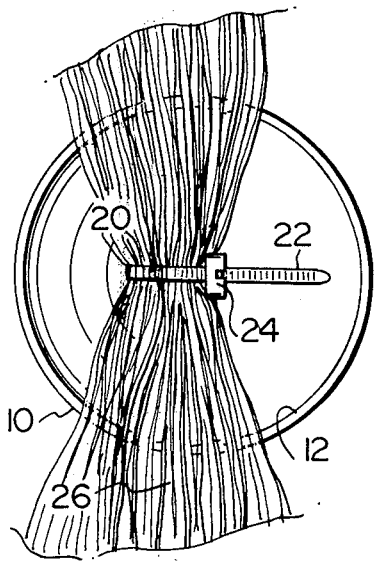
FIG. 3 is a plan view from below the holder of FIG. 1 showing the manner in which yarn is secured therein.

It will be understood that when strap 20 is tightened about the mid-points of lengths of yarn 26, as shown in FIG. 3, the yarn is drawn into the concave interior 12 of holder 2 and a very tight, even clamping force on the yarn, within concave interior 12 of holder 2 is attained. When strap 20 is thus tightened, it is very difficult to dislodge or remove any of the strands of yarn.

Figure 4:
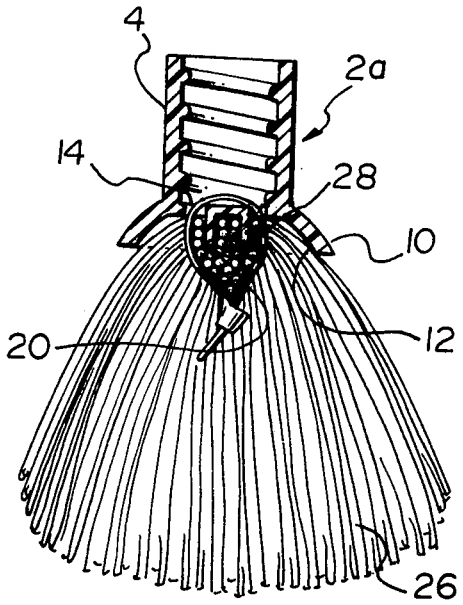
FIG. 4 is a section view, from the side, of a further embodiment of holder according to the present invention, with yarn in place.
Figure 5:
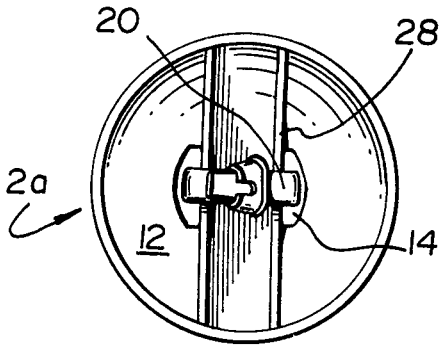
FIG. 5 is a plan view from below of the holder of FIG. 4 with no yarn.

Turnings to FIGS. 4 and 5, there is shown a further embodiment of the present invention. Holder 2*a* illustrated in these Figures is intended for use in securing the yarn of a toilet brush. As in the case of the yacht mop holder previously described and illustrated, toilet brush holder 2*a* comprises a similar cylindrical sleeve 4, the inner wall of which is threaded to received the threaded end of a handle for the toilet brush. Dome-shaped base 10 is integrally secured to the bottom end of sleeve 4, base 10 having a concave interior surface 12. Some-shaped base 10 however is not as extensive as that of the yacht mop holder of FIGS. 1 to 3. As well, across the top of the dome-shaped base of holder 2*a*, between spaced slots 14, extend a pair of linear shoulder walls 28. The function of these shoulder walls 28 is to assist in separating opposite parts of strap 20 where they pass through slots 14 into the interior portion of dome-shaped base 10, thereby reducing the possibility of these portions of strap 10 rubbing on each other and possibly tearing, if the yarns are subjected to twisting. Similar shoulder walls 28, although not illustrated, may be used on the base 10 for the yacht mop holder 2 of FIGS. 1, 2 and 3. It will be understood that a toilet brush made up using a holder according to the present invention instead of being entirely throwaway, as in the case of most currently sold commercial toilet brushes, may now consist of a permanent holder with only a throwaway yarn or throwaway holder and yarn.

Thus it is apparent that there has been provided in accordance with the present invention a holder for receiving the handle and securing the yarn of a yacht mop or the like that fully satisfies the objects, aims and advantages as set forth above. While the invention has been described in conjunction with a specific embodiments thereof, it is evident that many alternatives, modifications and variations, will be apparent to those skilled in the art in light of the foregoing description. Accordingly, it is intended to embrace all such alternatives, modifications and variations as fall within the spirit and broad scope of the appended claims.

What I claim as my invention:

1. A holder for receiving the handle and securing the yarn of of mop or brush comprising:

(a) a sleeve to receive in one end the handle of the mop or brush;

(b) a base having a concave interior surface against which the yarn is to be held, the base being centrally secured to the other end of the sleeve;

(c) a pair of spaced slots in the base extending through the base and located in the portion thereof circumscribed by the sleeve; and (d) a flexible bundling strap having an elongated body portion, one end of which it is a tail end and the other end of which is a clinching eyelet, through which the tail end of the strap is to pass and which is to securely hold the strap against unpurposeful disengagement, the strap being fitted in the slots so that its tail end and clinching eyelet are positioned on the concave interior side of the base, the yarn to be circumscribed by the strap and securely held thereby within the concave interior of the base.

2. A holder according to claim 1 wherein the sleeve is of cylindrical shape and threaded to receive a threaded handle end.

3. A holder according to claim 1 or 2 wherein the base and sleeve are of integral construction.

4. A holder according to claim 1 wherein the tail of the strap is of tapered width towards its end.

5. A holder according to claim 1 having yarn secured within the interior or the base by means of the bundling strap.

6. A holder according to claim 5 further comprising a handle releasably secured in the sleeve.

7. A holder according to claim 1 for securing the yarn of a yacht mop wherein the base is dome-shaped.

8. A holder according to claim 1 wherein a pair of spaced linear shoulder walls extend from the inner surface of the base between the slots to assist in separation of opposite portions of the strap on the concave interior side of the base in the vicinity of the slots.

* * * * *